US008390200B2

(12) United States Patent
Liu et al.

(10) Patent No.: US 8,390,200 B2
(45) Date of Patent: Mar. 5, 2013

(54) COAXIAL CAVITY GYROTRON WITH TWO ELECTRON BEAMS

(76) Inventors: Shenggang Liu, Chengdu (CN); Chaoyu Liu, Williamsburg, VA (US)

( * ) Notice: Subject to any disclaimer, the term of this patent is extended or adjusted under 35 U.S.C. 154(b) by 320 days.

(21) Appl. No.: 12/658,356

(22) Filed: Feb. 5, 2010

(65) Prior Publication Data

US 2010/0141143 A1 Jun. 10, 2010

Related U.S. Application Data

(63) Continuation-in-part of application No. 11/639,971, filed on Dec. 15, 2006, now abandoned.

(30) Foreign Application Priority Data

Dec. 16, 2005 (CN) ..... 2005 1 0022310

(51) Int. Cl.
*H01J 25/10* (2006.01)

(52) U.S. Cl. ..... 315/4; 315/5; 315/5.13; 315/5.31

(58) Field of Classification Search ..... 315/4, 5, 315/5.13, 5.16, 5.35, 111.81, 5.29, 5.31, 315/5.41, 39.51, 5.14; 313/3, 153, 306, 356
See application file for complete search history.

(56) References Cited

U.S. PATENT DOCUMENTS

| | | | | |
|---|---|---|---|---|
| 4,554,484 | A | 11/1985 | Read et al. | |
| 4,636,688 | A | 1/1987 | Ito | |
| 4,926,093 | A * | 5/1990 | Sugawara | 315/4 |
| 5,227,701 | A | 7/1993 | McIntyre | |
| 5,483,122 | A * | 1/1996 | Derbenev et al. | 315/5.41 |
| 5,610,482 | A * | 3/1997 | Dumbrajs et al. | 315/4 |
| 5,719,470 | A | 2/1998 | Hirata | |
| 5,780,969 | A * | 7/1998 | Sakamoto et al. | 315/5 |
| 5,780,970 | A | 7/1998 | Singh | |
| 5,814,939 | A * | 9/1998 | Chu et al. | 315/5.31 |

* cited by examiner

*Primary Examiner* — Jacob Y Choi
*Assistant Examiner* — Ephrem Alemu
(74) *Attorney, Agent, or Firm* — Williams Mullen

(57) ABSTRACT

A coaxial cavity gyrotron with two electron beams includes an electron gun (magnetron injection gun, "MIG," with two beams), a coaxial beam-wave interaction cavity and an outer magnetic field tube. The coaxial beam-wave interaction cavity consists of two parts: an outer conductor and an inner conductor. The two hollow electron beams produced by the MIG are located between the outer conductor and the inner conductor. The MIG includes inner and outer anodes, with a single cathode located between the anodes. The cathode further includes two emitter rings which produce the two hollow electron beams. The entire gyrotron is immersed in the magnetic field tube such that the magnetic field profile is the same or similar to that for a coaxial gyrotron with one electron beam.

9 Claims, 6 Drawing Sheets

COAXIAL CAVITY GYROTRON WITH TWO ELECTRON BEAMS

CROSS REFERENCE TO RELATED APPLICATIONS

The present Continuation-in-Part claims priority from U.S. patent application Ser. No. 11/639,971, filed Dec. 15, 2006, now abandoned and Chinese patent application no. 200510022310.4, filed Dec. 16, 2005.

BACKGROUND

1. Field of Invention

This invention relates generally to high-power millimeter-wave and terahertz facilities. Particularly, this invention relates to a coaxial cavity gyrotron and an electron gun in the nature of a special magnetic injection gun (MIG) providing two hollow electron beams.

2. Description of Relevant Art

Assuring the availability of energy sources is a significant issue confronting every country. Research and exploration of new energy sources are considered to be of great importance by many countries and scientists. Controlled thermonuclear fusion reaction may provide the most promising solution in the form of a new and clean energy source.

A high power gyrotron is the key device for plasma heating to produce the thermonuclear fusion, one of the most promising solutions to the human energy crisis. The ITER project is a world wide joint project for this purpose. However, the current gyrotrons are not able to provide one exact continuous wave megawatt.

In the planned International Thermonuclear Experimental Reactor, "ITER," project, high-density plasma is heated to hundred millions of degrees to result in a nuclear fusion reaction to produce a rich and clean source of energy. The key of this project is plasma heating. A gyrotron is applied in the heating process of ITER plasma. Therefore, having a gyrotron with increased continuous wave output power and improved efficiency are critical.

SUMMARY OF THE INVENTION

Disclosed is a gyrotron having an axis and a centrally and axially located inner anode, a single cathode with an inner electron emitter rings encircling the inner anode and an outer anode encircling the single cathode where the outer anode is encased in a magnetic field tube where electrons are emitted from the inner and outer electron emitter rings forming an inner hollow electron beam and a hollow outer electron beam respectively moving concentrically into a coaxial beam-wave interaction cavity formed from an inner conductor and an outer conductor where the inner and outer hollow electron beams are acted upon by the magnetic field of the magnetic tube.

Another embodiment is the outer anode is connected directly to the outer conductor of the coaxial beam-wave interaction cavity or through a dielectric insulator.

Another embodiment is the inner anode is connected directly to inner conductor of the coaxial beam-wave interaction cavity In another embodiment the coaxial beam-wave interaction cavity is surrounded by the magnetic field tube.

In another embodiment the outer conductor and the inner conductor the electrical potential is equal.

In another embodiment the inner hollow electron beam and outer hollow electron beam move in helical trajectories and are located in a desired position between the inner conductor and the outer conductor in the coaxial beam-wave interaction cavity.

In another embodiment the coaxial beam-wave interaction cavity, inner conductor, outer conductor, inner anode, single cathode and outer anode are concentric about an axis and generally circular about the axis.

In another embodiment the gyrotron is immersed in a desired adiabatic varying or uniform magnetic field.

In another embodiment the working current is higher than one electron beam gyrotrons therefore the output power is increased.

In another embodiment the inner electron beam and the outer electron beam can interact with different harmonic frequencies electromagnetic waves where one beam interacts with a lower harmonic frequency electromagnetic wave and another one interacts with a higher harmonic frequency electromagnetic wave and the two beams interact with two different modes respectively resulting in two modes of operation simultaneously.

In another embodiment the gyrotron may be used for controlled thermonuclear fusion, plasma heating and millimeter-wave and terahertz radar systems.

In accordance with the present invention a Coaxial Cavity Gyrotron (CCGT) system is composed of a Coaxial Cavity and a plurality of hollow electron beams. The hollow electron beams are produced by an electron gun. The electron beam-wave interaction transfers the kinetic energy of the electrons to the wave, and then the electromagnetic wave is greatly increased. The high power electromagnetic wave is output through an output window. In addition to being used in energy production, the Coaxial Gyrotron system can also be applied in millimeter wave radar systems and other areas in industry. The research of coaxial gyrotrons has attracted great attention in all over the world in order to enhance the output power, increase the efficiency and improve the mode competition.

An improved coaxial cavity gyrotron includes an electron gun capable of producing at least two electron beams, a magnetic field tube, and a coaxial cavity located within the magnetic field tube. The coaxial cavity gyrotron consists of an outer conductor and an inner conductor, in between which, the two electron beams are formed symmetrically. Both the coaxial cavity and the magnetic field tube are generally circular in cross-section. The coaxial cavity is located inside the magnetic field tube. The preferred electron gun of the present invention includes an inner anode, an outer anode and a cathode located in between the anodes; the inner anode is connected directly to inner conductor of the coaxial cavity. Two emitter rings are located on the cathode of the electron gun for forming the two hollow electron beams. The electron gun is immersed in an adiabatic varying magnetic field. In use, the coaxial cavity gyrotron is immersed in a uniform magnetic field.

DETAILED DESCRIPTION

Figure 1:
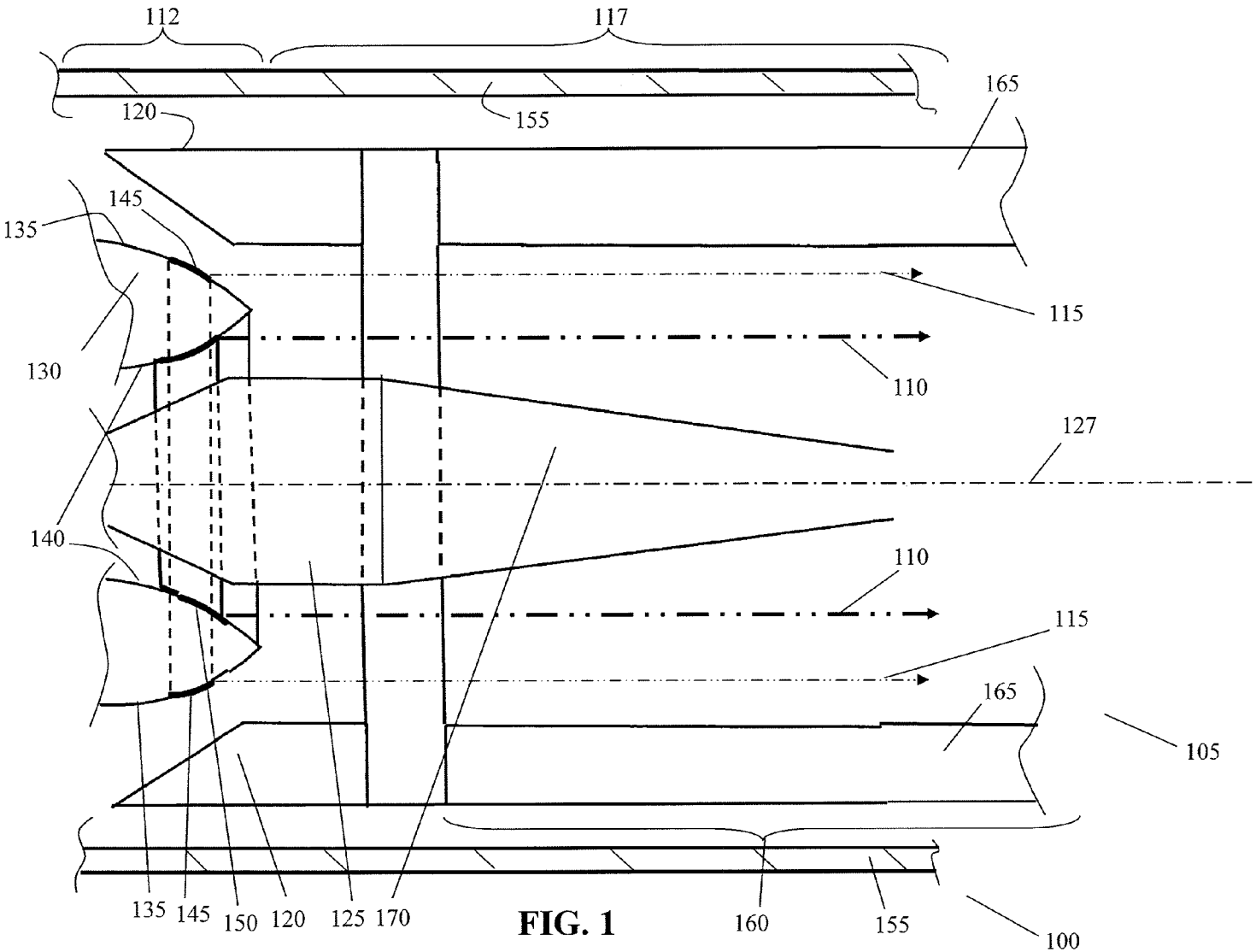
FIG. 1 is a schematic view of the CCGT with two electron beams.

The aim of this invention is to provide a Coaxial Cavity Gyrotron (CCGT), a new gyrotron [100] containing a magnetron injection gun (MIG) [105] producing an inner hollow electron beam [110] and an outer hollow electron beam [115]. As shown in the sectional details of FIGS. 1 and 2A-C, gyrotron [100] comprises a magnetic outer tube [155] having a first length along central axis [127] and a first width along its cross section. Magnetic outer tube [155] may be considered, with reference to the elements of MIG [105], as having a proximal first interior zone [112] and a distal second interior zone [117], as shown in FIG. 2A. Also as shown in FIG. 2A, the first interior zone [112] transitions to the second interior zone [117] at the coaxial beam-wave interaction cavity [160]; in other words, moving in a distal direction along central axis [127], coaxial beam-wave interaction cavity [160] (and second interior zone [117]) may be seen beginning at a point corresponding to the distal end of tubular cathode [130]. FIGS. 2B and 2C replicate FIG. 2A, and for convenience highlight parameters discussed herein, such as length, width, proximal end, and distal end. Length as used and claimed herein is conventionally along axis [127], with electron beams initiated or created at a proximal end and emitted in a distal direction (e.g., as described below). Width is conventionally orthogonal to length along axis [127], and distinguishes from a radial distance as embodiments are axial and, as described herein, may be concentric.

Unique to this gyrotron [100] is that there is only one tubular cathode [130] an outer anode [120] and the inner anode [125] to produce the inner hollow electron beam [110] and an outer hollow electron beam [115]. The outer anode [120] is connected directly to the outer tubular conductor [165] in the coaxial beam-wave interaction cavity [160] or may be connected through an insulated dielectric. The inner anode [125] is connected directly to the inner conductor [170] in the coaxial beam-wave interaction cavity [160].

An outer tubular conductor [165] is disposed within magnetic tube [155] about central axis [127]. Outer tubular conductor [165] has a second width that is less than the first width and a second length extending along the distal second interior zone [117] and into the proximal first interior zone [112], wherein a portion of the outer tubular conductor [165] connects to outer anode [120] in the first interior zone [112], with outer anode [120] disposed within magnetic outer tube [155] about central axis [127]. As noted above, a single tubular cathode [130] is disposed within magnetic outer tube [155] about central axis [127], and has a third width that is less than the second width and a third length extending along the first interior zone [112].

An inner conductor [170] is disposed within the magnetic tube [155] about the central axis [127]; inner conductor [170] has a fourth width that is less than the third width and a fourth length extending along the proximal first interior zone [112] and into the distal second interior zone [117]. A portion of the inner conductor [170] within the first interior zone [112] connects to an inner anode [125] disposed within the magnetic outer tube [155] about the central axis [127].

Thus, disposed within magnetic outer tube [155] are outer anode [120] and inner anode [125]. The inner anode [125] resides centrally along a first central axis [127] and centrally within a tubular cathode [130] along a first central axis [127]. The single tubular cathode [130] has a cathode outer surface [135] and a cathode inner surface [140]. The cathode outer surface [135] has an outer electron emitter ring [145] encircling tubular cathode [130] on the outer surface [135]. The cathode inner surface [140] has an inner electron emitter ring [150] encircling tubular cathode [130] on cathode inner surface [140]. Downstream of the tubular cathode [130] in distal second interior zone [117] is a coaxial beam-wave interaction cavity [160] in which the inner hollow electron beam [110] and outer hollow electron beam [115] pass. The outer tubular conductor [165] forms a coaxial beam-wave interaction cavity [165] outer surface, and the inner conductor [170] and the inner anode [125] form the coaxial beam-wave interaction cavity [165] inner surface, with an output end at its distal extremity.

Figure 2A:
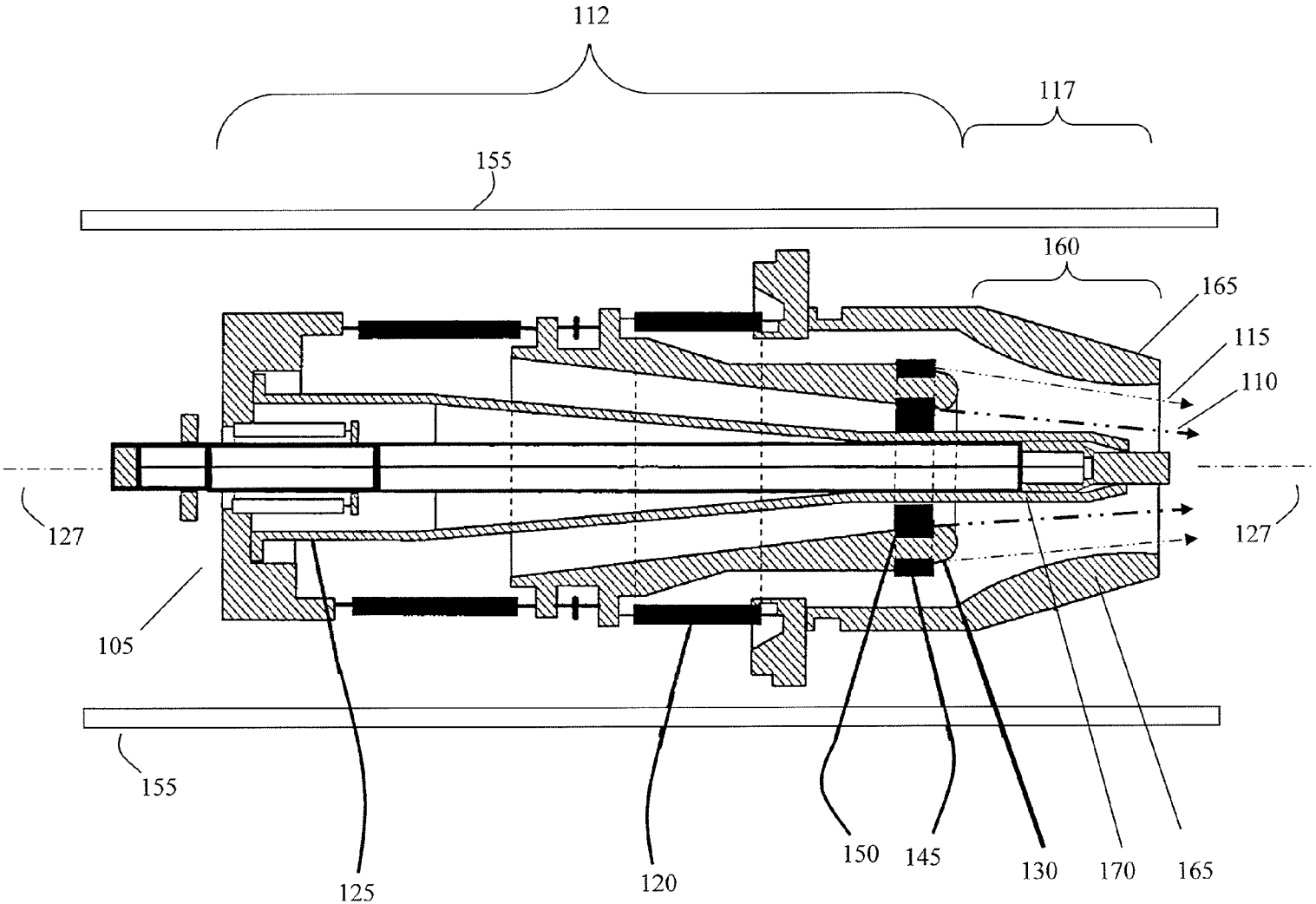
FIGS. 2A-C are cross-sectional views of an assembled CCGT with the special Magnetron Infection Gun (MIG)
Figure 2B:
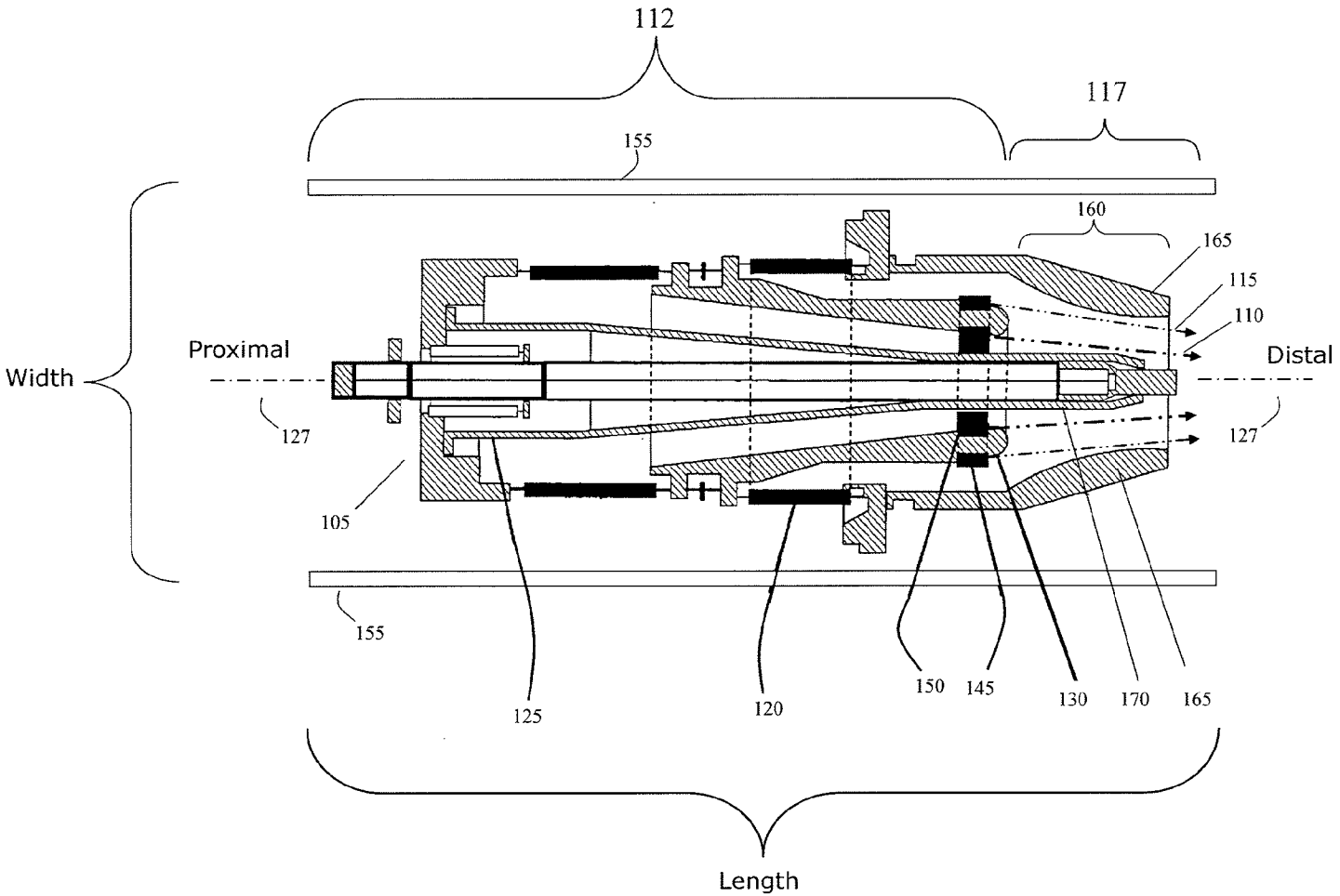
Figure 2C:
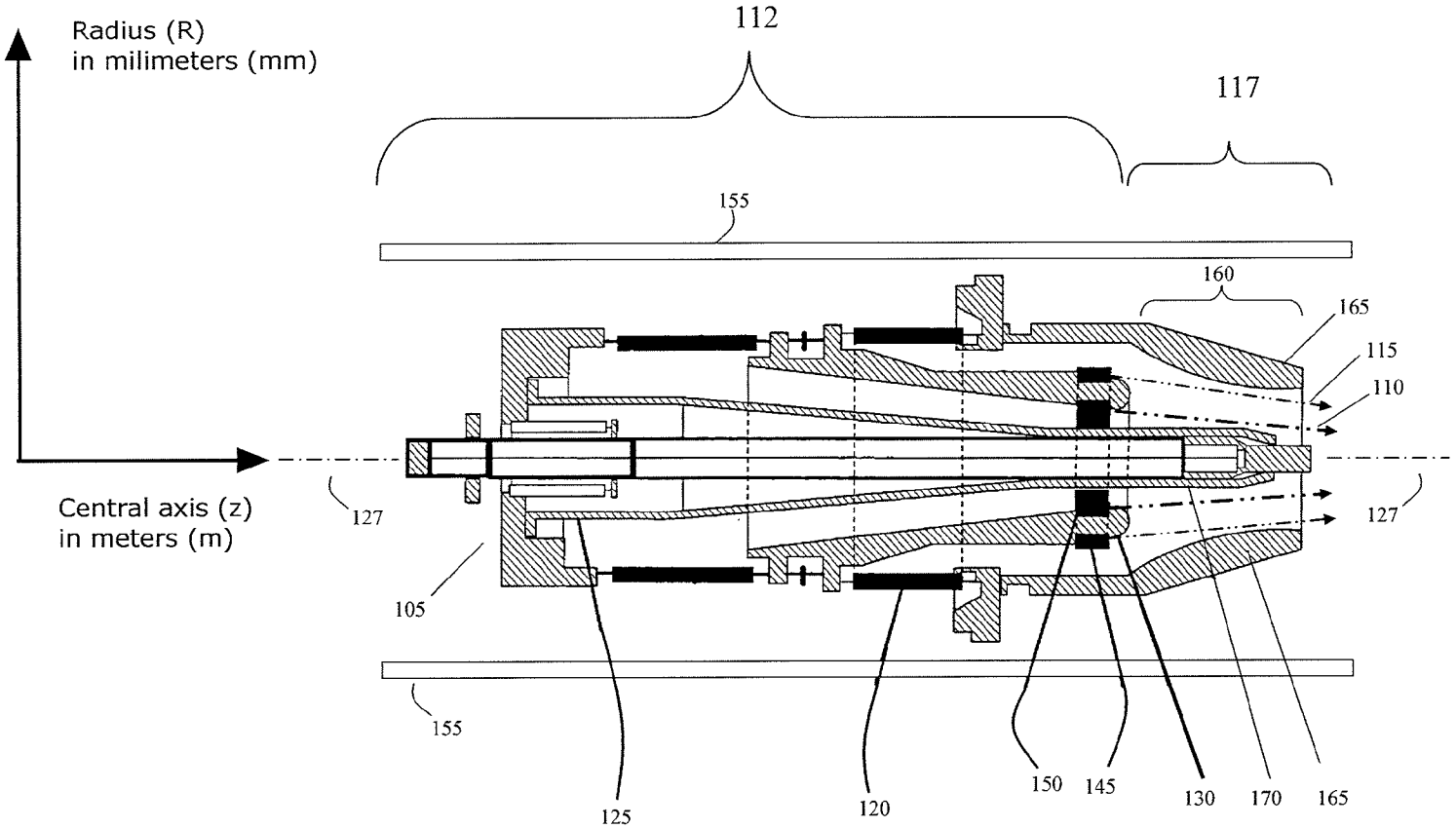

As shown in FIG. 1, the outer anode [120] encircles the single tubular cathode [130] within the magnetic outer tube [155]. The single tubular cathode [130] acts upon the inner and outer electron emitter rings [120, 125] so that electrons are emitted from the inner electron emitter ring [120] and the outer electron emitter ring [125], forming inner hollow electron beam [110] and outer hollow electron beam [115], respectively, moving along the central axis [127], concentric to each other, and distally toward the output end into the coaxial beam-wave interaction cavity [160].

The magnetic field of the inner anode [125] and the outer anode [120] act upon the inner and outer hollow electron beams [110, 115] within an electromagnetic field within the magnetic outer tube [155] so that the motion of electrons within the magnetic field is close to that of the electron cyclotron frequency within the coaxial beam-wave interaction cavity [160], and the single tubular cathode [130] and inner and outer anodes [125, 120] are configured such that the electromagnetic wave power of the inner and outer electron beams [110, 115] is increased along the central axis [127] in a direction of proximal to distal as the electron beams are transmitted from the output end.

Unlike earlier two beam gyrotrons, the coaxial beam-wave interaction cavity [160] can provide enough space for increasing the high power capacity of the coaxial beam-wave interaction cavity [160], meanwhile, it can also supply enough region of beam-wave interaction in the longitudinal direction. The efficiency in the coaxial beam-wave interaction cavity [160] allows for reaction in one mode or unitarily so that the interaction of the inner hollow electron beam [110] and the outer hollow electron beam [115] combined in the coaxial beam-wave interaction cavity [160] produces a power output that is higher by almost two times the power generated by previous single beam gyrotrons.

In operation the electrons are emitted from the outer ring electron emitter [145] and held in the hollow shape by the potential of the outer anode [120]. The electrons are also emitted from the inner ring electron emitter [150] which is also held in a hollow shape by the potential of the inner anode [125]. The normal trajectory of the emitted inner hollow electron beam [110] and the outer hollow electron beam [115] is concentric to each other and linear and around the outer surface of the respective hollow electron beam [110, 115]. The respective hollow electron beams [110, 115] flow into the coaxial beam-wave interaction cavity [160] where they are acted upon by the magnetic emissions from the surrounding magnetic outer tube [155].

The working process indicates that when the two coaxial hollow electron beams [110, 115] produced by the MIG [105], are injected into the coaxial cavity [160], these two coaxial and concentric hollow electron beams [110, 115] interact with electromagnetic wave inside the coaxial beam-wave interaction cavity [160]. When the motion of the electrons within the magnetic field inside the magnetic outer tube [155] known as the electron cyclotron frequency is close to electromagnetic wave frequency in the coaxial beam-wave interaction cavity [160], based on the theory of electron cyclotron maser instability, the electromagnetic wave power will be greatly increased in the coaxial beam-wave interaction cavity [160].

Select ion of the appropriate parameters of the inner hollow electron beam [110] and outer hollow electron beam [115] will cause them to interact with two different modes respectively. One beam works at a first (lower) harmonic and the other works at a second (higher) harmonic. Then in the coaxial beam-wave interaction cavity [160] there are two modes in operation simultaneously. The two hollow electron beams [110, 115] interact with two different frequency electromagnetic waves in the coaxial beam-wave interaction cavity [160] respectively. Therefore, one of the most important advantages of the CCGT is that it can operate at the Dual Frequency mode and one CCTG can output two different frequency high power electromagnetic waves.

FIGS. 2A-C are a cross sectional views of the MIG [105] with the magnetic tube [155], showing the major components such as the inner anode [125], outer anode [120], outer ring electron emitter [145], inner ring electron emitter [150], tubular cathode [130]. The inner beam [110] and outer beam [115] are also depicted as emitting from the inner ring electron emitter [150] and outer ring electron emitter [145].

Figure 4:
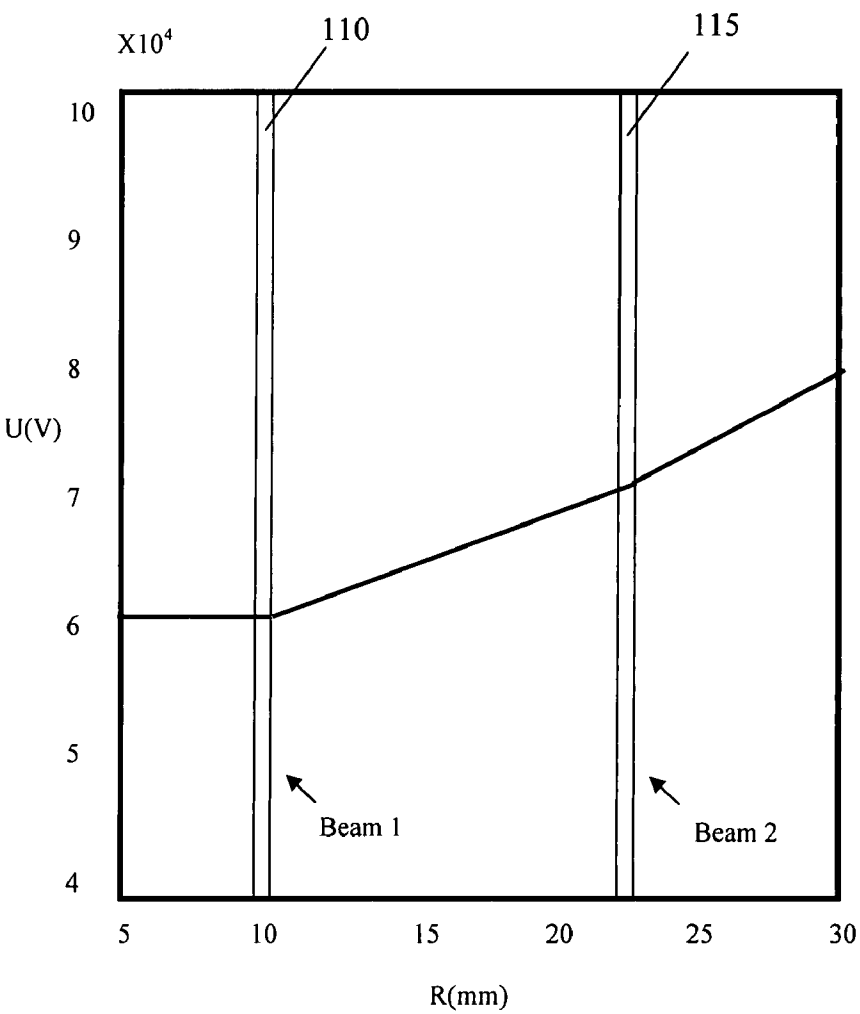
FIG. 4 is the electric potential of two beams in a hollow cylinder waveguide gyrotron.
Figure 3:
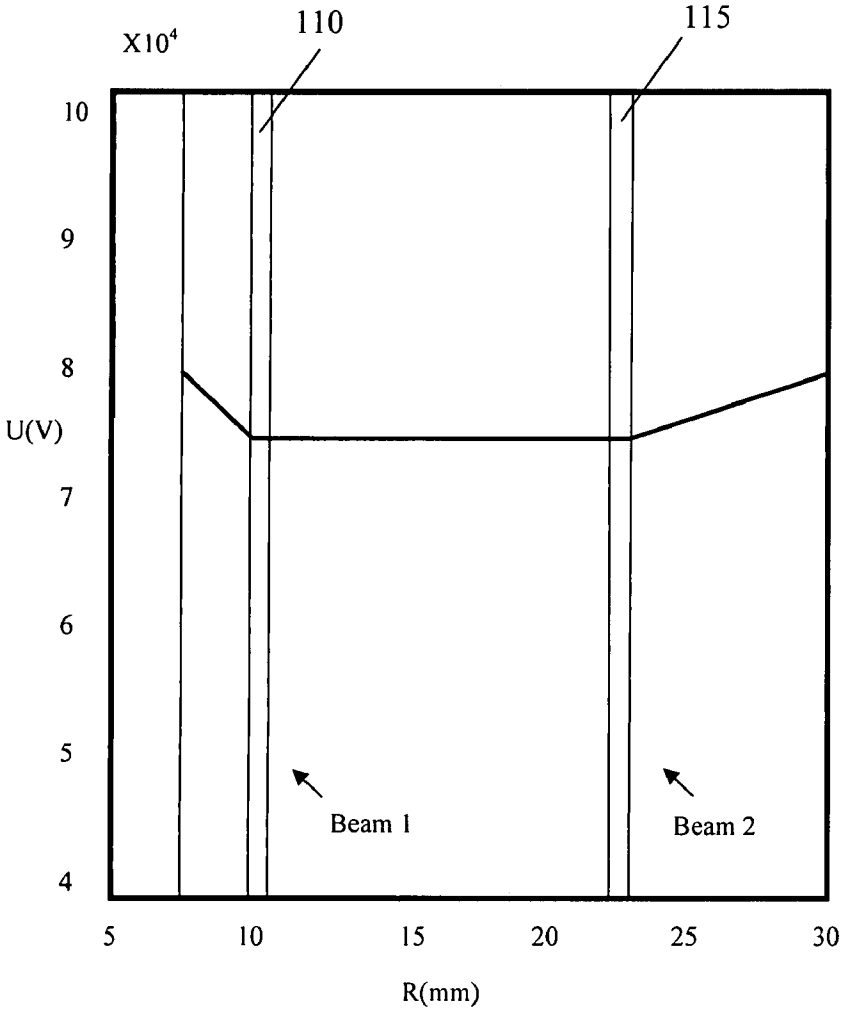
FIG. 3 is the electric potential of two beams in a coaxial gyrotron.

FIG. 3 shows the potential of the two beams [110, 115] in the present gyrotron [100] are equal even while the power is increased to a high power state. (See FIG. 3 where beam voltages are at 80 kV and current at 75 A. U(V) is the beam voltages in volts, R(mm) is the radius in millimeters), with a width shown by radius R in millimeters for coaxial displacement of the two beams [110, 115]. But FIG. 4 shows the potential of the two beams in a hollow cylinder waveguide without an inner conductor [170], it has been found (FIG. 4) that if there is more than one beam, in the quasi-optical or hollow cylindrical cavity of the present art, it can be shown that the potential of the second beam drops greatly when either beam current is increased.

Figure 5:
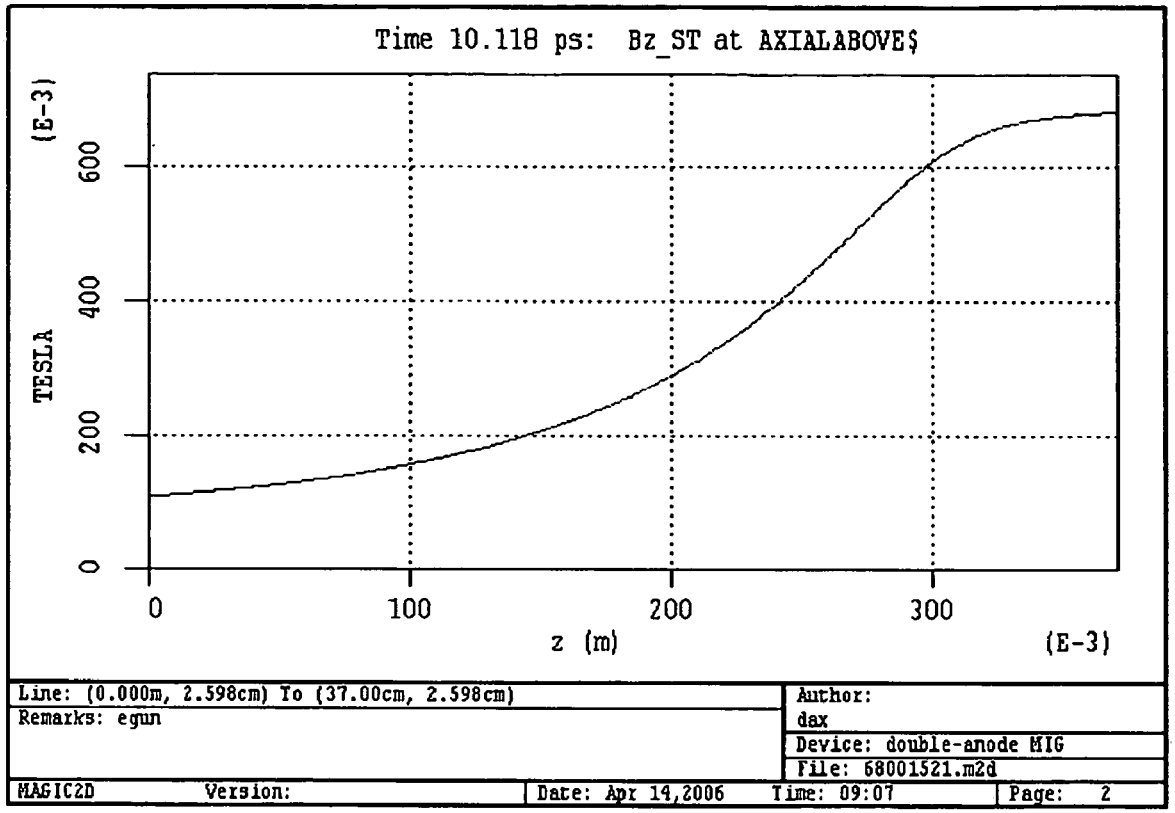
FIG. 5 is a magnetic field profile for the MIG.

The MIG [105] is immersed in an adiabatic varying magnetic field shown in FIG. 5, (where TESLA is the unit of magnetic field, z(m) is the central axis in meters) and the coaxial beam-wave interaction cavity [160] is immersed in a uniform magnetic field (i.e., in Teslas), moving from a proximal to a distal end along central axis [127] or z (in meters). Based on a theoretical study and computer simulations, the gyrotron [100] with two electron beams [110, 115] exhibits better performance when compared with an ordinary gyrotron with one electron beam. First, when the present gyrotron [100] with two electron beams [110, 115] is adopted, the total working current is greatly increased; therefore the output power will be increased by two times. Second, in the present gyrotron [100] with two electron beams [110, 115] the mode competition is also improved when the two-beam system is used.

While the present invention has been described with regards to particular embodiments, it is recognized that additional variations of the present invention may be devised without departing from the inventive concept. Many improvements, modifications, and additions will be apparent to the skilled artisan without departing from the spirit and scope of the present invention as described herein and defined in the following claims.

What is claimed is:

1. A gyrotron comprising;

a magnetic outer tube having a first length along a central axis and a first width along its cross section, the magnetic outer tube defining a first interior zone at its proximal end along the central axis followed by a second interior zone at its distal end along the central axis;

an outer tubular conductor disposed within the magnetic tube about the central axis having a second width that is less than the first width and a second length extending along the second interior zone and into the first interior zone, wherein a portion of the outer tubular conductor within the first zone connects to an outer anode disposed within the magnetic outer tube about the central axis;

a single tubular cathode disposed within the magnetic tube about the central axis having a third width that is less than the second width and a third length extending along the first interior zone;

an inner conductor disposed within the magnetic tube about the central axis having a fourth width that is less than the third width and a fourth length extending along the first interior zone and into the second interior zone, wherein a portion of the inner conductor within the first zone connects to an inner anode disposed within the magnetic outer tube about the central axis;

wherein the single tubular cathode further comprises an outer electron emitter ring encircling the single tubular cathode on an outer surface and an inner electron emitter encircling the single tubular cathode on an inner surface, respectively, such that the inner electron emitter also circles the inner anode;

wherein the outer tubular conductor forms a coaxial beam-wave interaction cavity outer surface, and the inner conductor and the inner anode form the coaxial beam-wave interaction cavity inner surface, with an output end at its distal extremity;

wherein the outer anode encircles the single tubular cathode within the magnetic outer tube;

wherein the single tubular cathode acts upon the inner and outer electron emitter rings so that electrons are emitted from the inner electron emitter ring and the outer electron emitter ring, forming an inner hollow electron beam and an outer hollow electron beam, respectively, moving along the central axis, concentric to each other, and distally toward the output end into the coaxial beam-wave interaction cavity, and the magnetic field of the inner anode and the outer anode act upon the inner and outer hollow electron beams within an electromagnetic field within the magnetic outer tube so that the motion of electrons within the magnetic field is close to that of the electron cyclotron frequency within the coaxial beam-wave interaction cavity, and the single tubular cathode and anodes are configured such that the electromagnetic wave power of the electron beams is increased along the central axis in a proximal to distal direction and the electron beams are transmitted from the output end.

2. The gyrotron of claim 1, wherein the outer anode is connected directly to the outer tubular conductor or through a dielectric insulator.

3. The gyrotron of claim 1, wherein the inner anode is connected directly to the inner conductor.

4. The gyrotron of claim 1, wherein the coaxial beam-wave interaction cavity is surrounded by the magnetic outer tube.

5. The gyrotron of claim 1, wherein the outer tubular conductor and the inner conductor have an equal electrical potential.

6. The gyrotron of claim 1, wherein the inner hollow electron beam and outer hollow electron beam move distally in helical trajectories and are located in a desired position within the outer tubular conductor in the coaxial beam-wave interaction cavity.

7. The gyrotron of claim 1, wherein the coaxial beam-wave interaction cavity, inner conductor, outer tubular conductor, inner anode, single tubular cathode and outer anode are concentric about the central axis and generally circular about the central axis.

8. The gyrotron of claim 1, wherein the inner hollow electron beam and outer hollow electron beam interact unitarily within the coaxial beam-wave interaction cavity combining to produce an output power that is about two times that of a gyrotron with one electron beam.

9. The gyrotron of claim 1, wherein inner hollow electron beam and outer hollow electron beam interact to each other in two different modes respectively in the coaxial beam-wave interaction cavity, wherein one beam is at a first harmonic frequency and the other beam is at a second higher harmonic frequency in the coaxial beam-wave interaction cavity resulting in two modes of operation simultaneously.

* * * * *